US010375469B2

(12) United States Patent
Qin

(10) Patent No.: US 10,375,469 B2
(45) Date of Patent: Aug. 6, 2019

(54) SPEAKER BOX

(71) Applicant: AAC Technologies Pte. Ltd., Singapore (SG)

(72) Inventor: Peng Qin, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/856,830

(22) Filed: Dec. 28, 2017

(65) Prior Publication Data

US 2019/0014405 A1 Jan. 10, 2019

(30) Foreign Application Priority Data

Jul. 4, 2017 (CN) ..... 2017 1 0537255

(51) Int. Cl.
*H04R 1/28* (2006.01)
*H04R 31/00* (2006.01)
*H04R 1/02* (2006.01)

(52) U.S. Cl.
CPC ..... *H04R 1/2888* (2013.01); *H04R 1/025* (2013.01); *H04R 31/00* (2013.01); *H04R 1/023* (2013.01)

(58) Field of Classification Search
CPC . H04R 9/00; H04R 9/06; H04R 9/025; H04R 9/04; H04R 9/043; H04R 9/045; H04R 9/046; H04R 9/047; H04R 1/02; H04R 1/06; H04R 31/006; H04R 2209/041; H04R 1/2888; H04R 31/00; H04R 1/025
USPC ..... 381/150
See application file for complete search history.

(56) References Cited

U.S. PATENT DOCUMENTS 6,763,110 B1 * 7/2004 Sung ..... H04M 1/0202 379/433.02
7,556,121 B2 * 7/2009 Yang ..... H04M 1/03 181/145
7,894,620 B2 * 2/2011 Yang ..... H04R 1/021 379/433.02
7,953,461 B2 * 5/2011 Fukazawa ..... H04M 1/03 455/569.1
8,259,985 B2 * 9/2012 Yang ..... H04R 1/021 381/386
8,885,867 B1 * 11/2014 Tai ..... H04R 1/345 381/333
9,154,865 B2 * 10/2015 Zha ..... H04R 1/021
9,167,324 B2 * 10/2015 Yang ..... H04R 1/02
9,414,140 B2 * 8/2016 Wang ..... H04R 1/021
9,525,933 B2 * 12/2016 Chen ..... H04R 1/2842
9,832,565 B2 * 11/2017 Zhang ..... H04R 1/2803
9,883,266 B2 * 1/2018 Dai ..... H04R 9/06
10,149,062 B2 * 12/2018 Zhang ..... H04R 9/06
(Continued)

*Primary Examiner* — Oyesola C Ojo
(74) *Attorney, Agent, or Firm* — Na Xu; IPro, PLLC

(57) ABSTRACT

A speaker box, includes a housing and a speaker unit accommodated in the housing. The speaker unit includes a diaphragm for forming a front sound cavity cooperatively with the housing. The box further includes a sound transmitting channel communicating the front sound cavity and outside, a front cavity of the speaker box formed by the front sound cavity and the sound transmitting channel, a through hole formed in the housing corresponding to the front cavity, and an elastic cover plate disposed on the housing and covering the through hole. A resonance frequency of the elastic cover plate is greater than a working frequency range of the speaker unit.

7 Claims, 3 Drawing Sheets

(56) References Cited

U.S. PATENT DOCUMENTS

| | | | | |
|---|---|---|---|---|
| 2004/0029530 | A1* | 2/2004 | Noguchi | H04R 5/023 455/23 |
| 2007/0116321 | A1* | 5/2007 | Jang | H04M 1/035 381/388 |
| 2008/0165996 | A1* | 7/2008 | Saito | H04R 25/60 381/322 |
| 2010/0247857 | A1* | 9/2010 | Sanami | H04M 1/18 428/138 |
| 2012/0135787 | A1* | 5/2012 | Kusunoki | H04M 1/0214 455/575.8 |
| 2012/0275637 | A1* | 11/2012 | Liao | H04R 1/025 381/395 |
| 2013/0094685 | A1* | 4/2013 | Seo | H04R 1/021 381/332 |
| 2013/0223655 | A1* | 8/2013 | Lee | H04M 1/035 381/189 |
| 2013/0271902 | A1* | 10/2013 | Lai | H04R 1/02 361/679.01 |
| 2013/0322672 | A1* | 12/2013 | Wang | H04R 1/02 381/332 |
| 2014/0023224 | A1* | 1/2014 | Tao | H04R 1/02 381/412 |
| 2014/0119592 | A1* | 5/2014 | Choi | H04R 9/025 381/412 |
| 2014/0193014 | A1* | 7/2014 | Hsieh | H04R 1/02 381/332 |
| 2014/0294225 | A1* | 10/2014 | Ji | H04R 1/023 381/386 |
| 2015/0163572 | A1* | 6/2015 | Weiss | H04R 1/02 381/337 |
| 2016/0295316 | A1* | 10/2016 | Shao | H04R 1/025 |
| 2018/0152800 | A1* | 5/2018 | Cai | H04R 9/046 |

* cited by examiner

SPEAKER BOX

CROSS-REFERENCE TO RELATED APPLICATIONS

This application claims the priority benefit of Chinese Patent Application Ser. No. 201710537255. 5 filed on Jul. 4, 2017, the entire content of which is incorporated herein by reference.

FIELD OF THE PRESENT DISCLOSURE

The present disclosure relates to electro-acoustic transducers, more particularly to a housing of a speaker box.

DESCRIPTION OF RELATED ART

With the arrival of mobile internet era, the number of intelligent mobile devices is on the increase. Among the many mobile devices, mobile phones are undoubtedly the most common, most portable mobile terminal devices. At present, the mobile phone functions are extremely diverse, one of which is high quality music function, therefore, the speaker boxes used to play sounds are applied to current smart mobile devices in large quantities.

The speaker box of related art comprises a housing, a speaker unit accommodated in the housing, a leaking hole provided as penetrating the housing and a cover plate provided as covering the leaking hole, wherein, the speaker unit comprises a diaphragm for vibration and sound producing, the diaphragm is provided spaced from the housing to form a front sound cavity. The leaking hole and the diaphragm are provided opposite each other. The speaker box further comprises a sound guiding channel connecting the front sound cavity and the external environment, the front sound cavity and the sound channel form together the front cavity of the speaker box.

However, in the speaker box of related art, the inner walls of the front cavity are all rigid walls made up of rigid plastic material or metal material, the damp and the vibration amplitude of a rigid wall are small, its radiation energy is limited, and cannot effectively transmit the cavity energy in the front cavity out, thus it cannot absorb the energy of a specified frequency. Therefore, the rigid walls of the front cavity are prone to resonance because of the structure, which will then lead to sound distortion in the speaker box, affecting the acoustic performance of the speaker box.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
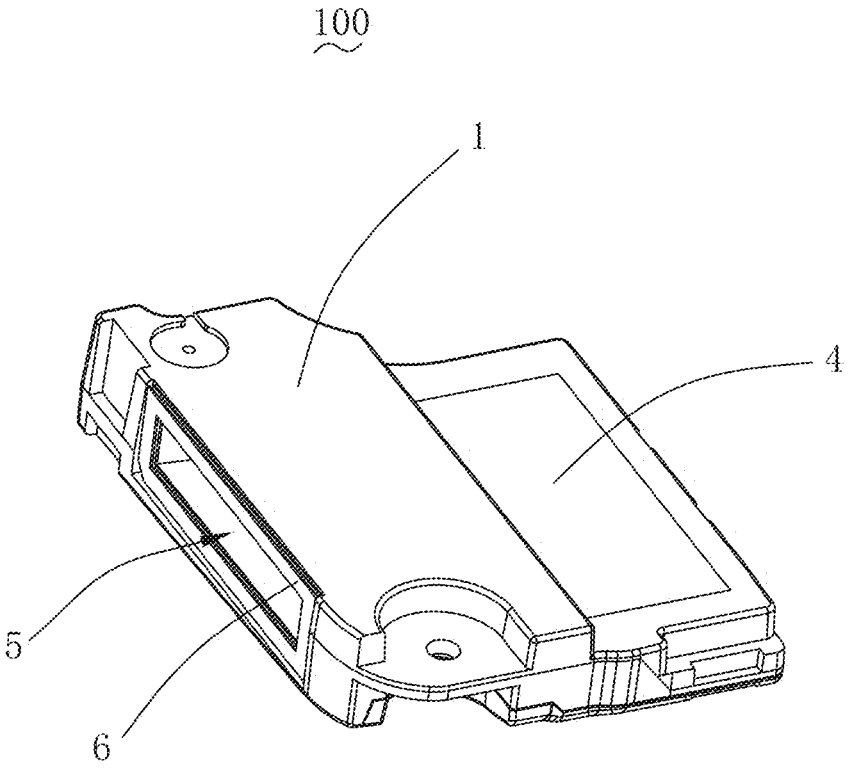
FIG. 1 is an isometric view of a speaker box in accordance with an exemplary embodiment of the present disclosure.
Figure 2:
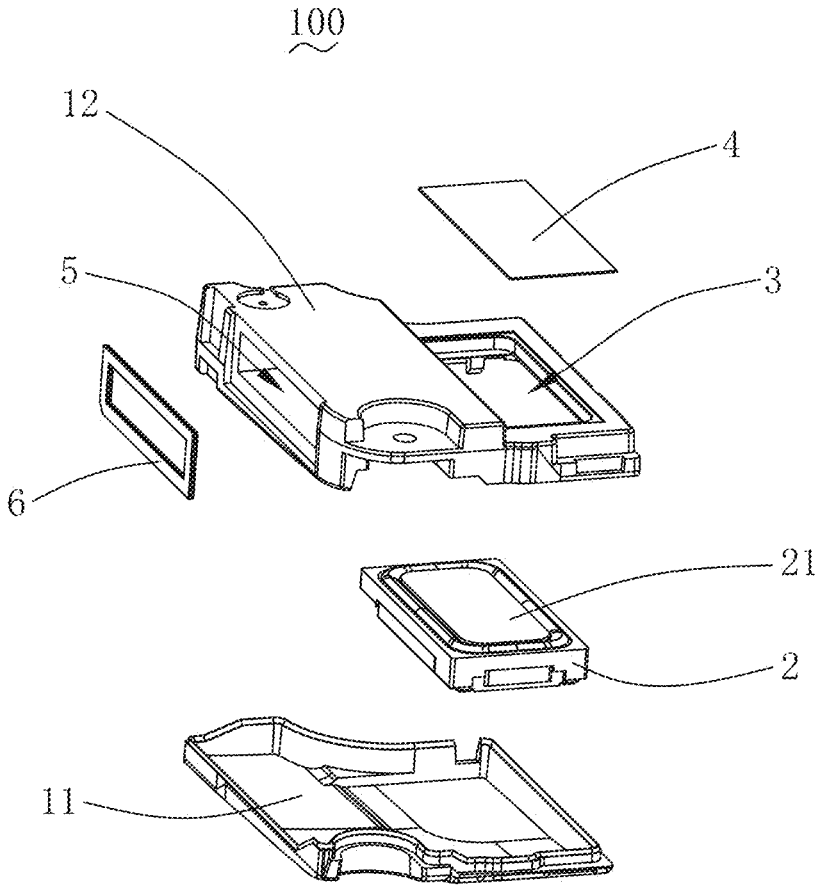
FIG. 2 is an exploded view of the speaker box in FIG. 1.
Figure 3:
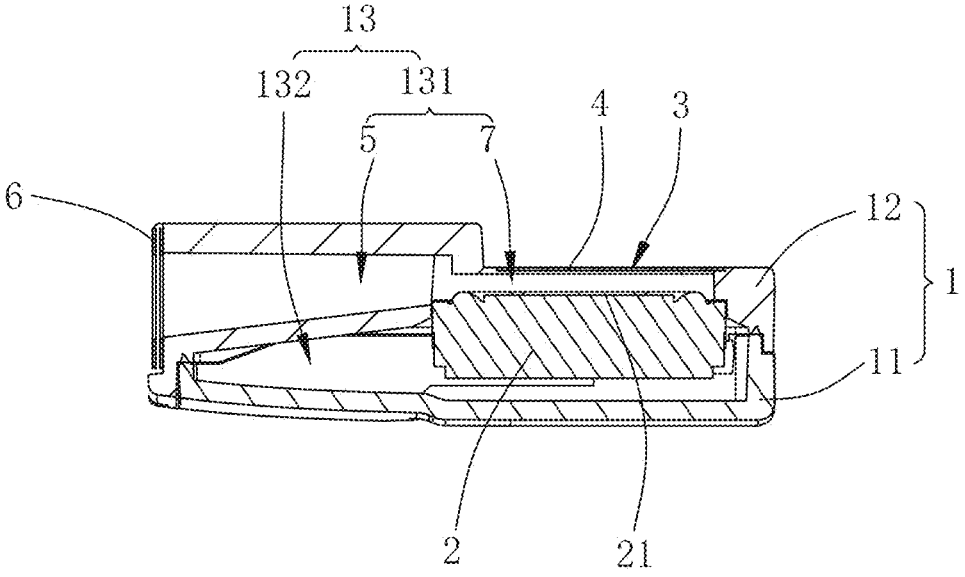
FIG. 3 is a cross-sectional view of the speaker box.

Referring to FIGS. 1-3, the present invention provides a speaker box 100 comprising a housing 1, a speaker unit 2, a through hole 3, a cover plate 4, a sound transmitting channel 5, and an adhesive pad 6.

The speaker unit 2 is accommodated in the housing 1.

In this embodiment, the housing 1 comprises a lower plate 11 and an upper cover 12 which form jointly with the lower plate 11 an accommodating space 13. The speaker unit 2 is fixed in the accommodation space 13.

The speaker unit 2 comprises a diaphragm 21 for vibration and sound producing, the diaphragm 21 and the housing 1 are provided spaced apart to form a front sound cavity 7.

The through hole 3 is provided as penetrating the housing 1 and is connected with the front sound cavity 7. In the present embodiment, the through hole 3 is provided as penetrating the upper cover 12. Preferably, the through hole 3 and the diaphragm 21 are provided rightly opposite each other.

The cover plate 4 is provided as covering the housing 1 and covers the through hole 3, in this embodiment, the cover plate 4 is provided as embedded in the upper cover 12 and covers the through hole 3.

Specifically, the cover plate 4 is provided as embedded in the side of the upper cover 12 far from the diaphragm 21. Preferably, the cover plate 4 and the upper cover 12 are formed by integrated injection molding, which will increase the structural stability of the speaker box 100.

The cover plate of the related art is a steel plate, and the vibration resonance frequency of the steel plate is f, $$f = 0.467 * \frac{h}{a^2} * \sqrt{\frac{E}{3\rho(1-\sigma^2)}}$$

In which, h is the thickness of the steel plate, $a^2$ is the area of the steel plate, and E is the Young's modulus of the steel plate, ρ is the density of the steel plate, and σ is the Poisson's ratio.

When a resonance is produced in the steel plate, a trough appears on the frequency response curve of the speaker box 100, and a peak appears on the distortion curve, that is, the distortion degree of the speaker box 100 is large, and thus the acoustic performance is poor.

Thus, to make sure that the speaker box 100 will not be affected by the resonance of the steel plate, it is necessary to increase the resonance frequency of the steel plate so as to keep it away from the frequency of the working frequency band of the speaker unit 2.

Therefore, in this embodiment, the resonance frequency of the material of which the cover plate 4 be made of needs to be greater than the resonance frequency of the working frequency band of the speaker unit 2.

In the present embodiment, the cover plate 4 is made of alumina ceramic material, and of course, the material of which the cover plate 4 be made of is not limited to this.

The Young's modulus of the steel plate E is 200 Gpa, its density is 7.7 g/cm$^3$, and its Poisson's ratio is 0.28. While the Young's modulus of the alumina ceramic E is 300-500 Gpa, its density is 3.8 g/cm$^3$, its Poisson's ratio is 0.22. It can be calculated by the formula above that, for cover plates 4 of the same shape and thickness, the resonance frequency of alumina ceramic material is 3-4 times greater than that of steel, thus the resonance frequency of the cover plate 4 can be effectively improved. That is, the cover plate 4 made of alumina ceramic material will not affect the resonance frequency of the speaker unit 2, improving the acoustic performance of the speaker box 100.

The sound transmitting channel 5 is formed in the housing 1, specifically, the sound transmitting channel 5 is formed on the upper cover 12. The sound transmitting channel 5 connects the front sound cavity 7 with the outside, by which a side sound producing structure is formed. That is to say, in this embodiment, the diaphragm 21 (the speaker unit 2) divides accommodating space 13 into a front cavity 131 and a back cavity 132, in which, the front cavity 131 comprises the front sound cavity 7 and the sound transmitting channel 5, which are used for transmitting sound; the back cavity 132 has the function of improving the low frequency acoustic performance of the speaker box 100. The through hole 3 can be provided at the position of the housing 1 corresponding to the front cavity 131.

The adhesive pad 6 is provided as affixed to the outside of the sound transmitting channel 5, when the speaker box 100 is installed in other applied product, the adhesive pad 6 can, on one hand, paste and fix the loudspeaker box 100 on the applied product and improve its stability, and on the other hand, act as a buffer when the two of them collide.

Compared with the related art, in the speaker box of the invention, the cover plate of the through hole is made of alumina ceramic material, which makes the resonance frequency of the cover plate far greater than that of the working frequency band of the speaker unit, avoiding the situation where, when the speaker box is working, a resonance is generated in the cover plate and the acoustic performance of the speaker box is therefore affected, thereby improving the acoustic performance of the speaker box.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a housing;

a speaker unit accommodated in the housing, the speaker unit including a diaphragm for forming a front sound cavity cooperatively with the housing;

a sound transmitting channel communicating the front sound cavity and outside;

a front cavity of the speaker box formed by the front sound cavity and the sound transmitting channel;

a through hole formed in the housing corresponding to the front cavity, the through hole and the diaphragm provided rightly opposite each other;

an elastic cover plate disposed on the housing and covering the through hole, the elastic cover plate provided opposite to the diaphragm and covering the front sound cavity, a resonance frequency of the elastic cover plate being greater than a working frequency range of the speaker unit.

2. The speaker box as described in claim 1, wherein the cover plate is made of alumina or ceramic material.

3. The speaker box as described in claim 1, wherein the housing comprises a lower cover and an upper cover for forming an accommodation space, the speaker unit is fixed in the accommodation space, the diaphragm and the upper plate form the front sound cavity, the sound transmitting channel is formed at the upper cover, the through hole is provided at the upper cover.

4. The speaker box as described in claim 3, wherein the cover plate is embedded in the upper cover.

5. The speaker box as described in claim 4, wherein the cover plate is embedded in the side of the diaphragm far from the upper cover.

6. The speaker box as described in claim 5, wherein the cover plate and the upper cover are formed by integrated injection molding.

7. The speaker box as described in claim 1 further including an adhesive pad affixed outside of the sound guiding channel.

* * * * *